US010662598B2

(12) United States Patent
Donner

(10) Patent No.: US 10,662,598 B2
(45) Date of Patent: May 26, 2020

(54) DRYING DEVICE AND METHOD

(71) Applicant: Scott M. Donner, Durham, NC (US)

(72) Inventor: Scott M. Donner, Durham, NC (US)

( * ) Notice: Subject to any disclaimer, the term of this patent is extended or adjusted under 35 U.S.C. 154(b) by 133 days.

(21) Appl. No.: 15/772,415

(22) PCT Filed: Jan. 6, 2017

(86) PCT No.: PCT/US2017/012536
§ 371 (c)(1),
(2) Date: Apr. 30, 2018

(87) PCT Pub. No.: WO2017/120474
PCT Pub. Date: Jul. 13, 2017

(65) Prior Publication Data

US 2018/0320330 A1 Nov. 8, 2018

Related U.S. Application Data

(60) Provisional application No. 62/376,976, filed on Aug. 19, 2016, provisional application No. 62/293,944,
(Continued)

(51) Int. Cl.
*E01H 1/10* (2006.01)
*E01H 1/12* (2006.01)
(Continued)

(52) U.S. Cl.
CPC ..... *E01H 1/108* (2013.01); *E01H 1/12* (2013.01); *A63B 61/00* (2013.01); *A63B 2225/30* (2013.01)

(58) Field of Classification Search
CPC ..... E01H 1/108; E01H 1/12; A63B 61/00; A63B 2225/30; A47L 13/11; A47L 13/12; A47L 13/16; A47L 13/20; A47L 13/256
(Continued)

(56) References Cited

U.S. PATENT DOCUMENTS 3,967,339 A 7/1976 Newman
4,445,247 A 5/1984 Johannessen
(Continued)

FOREIGN PATENT DOCUMENTS

CN 201398920 Y 2/2010
WO WO 2001/037716 5/2001

OTHER PUBLICATIONS

International Preliminary Report on Patentability corresponding to International Patent Application No. PCT/US2017/012536 dated Jul. 10, 2018.
(Continued)

*Primary Examiner* — Weilun Lo
(74) *Attorney, Agent, or Firm* — Jenkins, Wilson, Taylor & Hunt, P.A.

(57) ABSTRACT

Disclosed is a drying device, which comprises: (a) one or more fabric panels of sufficient dimension to be dragged across a surface, optionally an outdoor surface; and (b) a handle attached to the one or more fabric panels, In some embodiments, the drying device comprises: (a) two or more fabric panels of sufficient dimension to be dragged across a surface, optionally an outdoor surface; (b) a handle attached to the two or more fabric panels; and (c) a scraper attached to the handle, wherein the scraper is adapted to engage a surface to be dried when the drying device is in use. Methods and systems for a drying a surface are also disclosed.

15 Claims, 17 Drawing Sheets

Related U.S. Application Data filed on Feb. 11, 2016, provisional application No. 62/275,433, filed on Jan. 6, 2016.

(51) Int. Cl.
*A47L 13/11* (2006.01)
*A47L 13/20* (2006.01)
*A63B 61/00* (2006.01)

(58) Field of Classification Search
USPC ..... 15/228
See application file for complete search history.

(56) References Cited

U.S. PATENT DOCUMENTS

| | | | | |
|---|---|---|---|---|
| 5,198,036 | A | 3/1993 | Sotolongo | |
| 5,306,393 | A | 4/1994 | Rhyne | |
| 6,049,943 | A | 4/2000 | Carter | |
| 6,298,578 | B1 | 10/2001 | Frampton | |
| 7,363,675 | B2 | 4/2008 | Gavney | |
| 7,454,846 | B2 | 11/2008 | Brobeck | |
| 8,510,894 | B2 * | 8/2013 | Mrouse | A47L 13/10 15/230.11 |
| 8,756,745 | B1 * | 6/2014 | Feeny | A47L 13/252 15/115 |
| 9,095,247 | B2 | 8/2015 | Rekola | |
| 2004/0244133 | A1 | 12/2004 | Li | |
| 2006/0179596 | A1 * | 8/2006 | Sharratt | A47L 13/20 15/230.11 |
| 2009/0249640 | A1 | 10/2009 | Sufleta | |
| 2010/0205758 | A1 | 8/2010 | Levitt et al. | |
| 2013/0192082 | A1 | 8/2013 | Young | |
| 2015/0059804 | A1 | 3/2015 | Bergez | |

OTHER PUBLICATIONS

Amazon (2016) Tourna-Dri Tennis Court PVA Squeegee. http://www.amazon.com/Tourna-Dri-Tennis-Court-PVA-Squeegee/dp/B004QM5WWY 1-6.

International Search Report and Written Opinion of the International Searching Authority corresponding to International Patent Application No. PCT/US2017/012536 dated May 18, 2017.

* cited by examiner

DRYING DEVICE AND METHOD

CROSS REFERENCE TO RELATED APPLICATIONS

The present application claims priority to and the benefit of U.S. Patent Application Ser. No. 62/275,433, filed Jan. 6, 2016; U.S. Patent Application Ser. No. 62/293,944, filed Feb. 11, 2016; and U.S. Patent Application Ser. No. 62/376,976, filed Aug. 19, 2016, the disclosure of each of which is hereby incorporated herein by reference in its entirety.

TECHNICAL FIELD

The subject matter disclosed herein relates generally to the design of a drying device and to methods of using a drying device, such as a drying device that can be used to dry an outdoor surface, like a tennis court.

BACKGROUND

Outdoor surfaces, such as tennis courts or basketball courts, cannot be used effectively when they are wet. This is particularly the case where puddles of liquid have formed on the surface, such as puddles of water after a rain storm. Thus, devices and methods for drying surfaces, such as outdoor surfaces, represent a continuing need in the art.

SUMMARY

This Summary lists several embodiments of the presently disclosed subject matter, and in many cases lists variations and permutations of these embodiments. This Summary is merely exemplary of the numerous and varied embodiments. Mention of one or more representative features of a given embodiment is likewise exemplary. Such an embodiment can typically exist with or without the feature(s) mentioned; likewise, those features can be applied to other embodiments of the presently disclosed subject matter, whether listed in this Summary or not. To avoid excessive repetition, this Summary does not list or suggest all possible combinations of such features.

In accordance with some embodiments of the presently disclosed subject matter a drying device is provided. In some embodiments, the drying device comprises: (a) one or more fabric panels of sufficient dimension to be dragged across a surface, optionally an outdoor surface; and (b) a handle attached to the one or more fabric panels. In some embodiments, the one or more fabric panels comprises two or more panels.

In some embodiments, the drying device comprises: (a) two or more fabric panels of sufficient dimension to be dragged across a surface, optionally an outdoor surface; (b) a handle attached to the two or more fabric panels; and (c) a scraper attached to the handle, wherein the scraper is adapted to engage a surface to be dried when the drying device is in use, optionally wherein the weight of the two or more panels and/or resistance of the two or more panels as they are dragged across a surface to be dried act as a counterbalance to drive the scraper to engage the surface to be dried.

In some embodiments, the one or more fabric panels comprises a microfiber fabric. In some embodiments, the microfiber fabric is a fabric commercially available under the trademark EVOLON®. In some embodiments, the one or more fabric panels comprise a sleeve defined by the one or more fabric panels and the handle contacts the sleeve.

In some embodiments, the handle comprises a pipe and a rope, wherein the rope is threaded through the pipe and/or attached at each end of the pipe. In some embodiments, the handle comprises a first pipe and a second pipe, oriented such that the one or more fabric panels and/or the sleeve is encased between the first and second pipes. In some embodiments, the device comprises an end cap placed on each end of the handle. In some embodiments, the device comprises a hook at each end of the handle or one or more hooks disposed along the rope. In some embodiments, the device comprises a logo on at least one side.

In some embodiments, the device comprises a scraper attached to the handle. Optionally, the scraper is adapted to engage a surface to be dried when the drying device is in use. Optionally, the weight of the one or more panels and/or resistance of the one or more panels as it is/they are dragged across a surface to be dried act as a counterbalance to drive the scraper to engage the surface to be dried.

In some embodiments, a system for drying a surface is provided. In some embodiments, the system comprises: (a) a drying device in accordance with the presently disclosed subject matter; and (b) a bag for carrying the drying device. In some embodiments, the bag comprises a logo on at least one side.

In some embodiments, a method of drying a surface is provided. In some embodiments, the method comprises: providing a drying device in accordance with the presently disclosed subject matter; and (b) contacting a surface to be dried with the drying device. In some embodiments, the surface to be dried is an outdoor hard court. In some embodiments, the outdoor hard court is a tennis court.

It is an object of the presently disclosed subject matter to provide a drying device and method.

An object of the presently disclosure having been stated hereinabove, and which is achieved in whole or in part by the presently disclosed subject matter, other objects will become evident as the description proceeds when taken in connection with the accompanying drawings as best described herein below.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1:
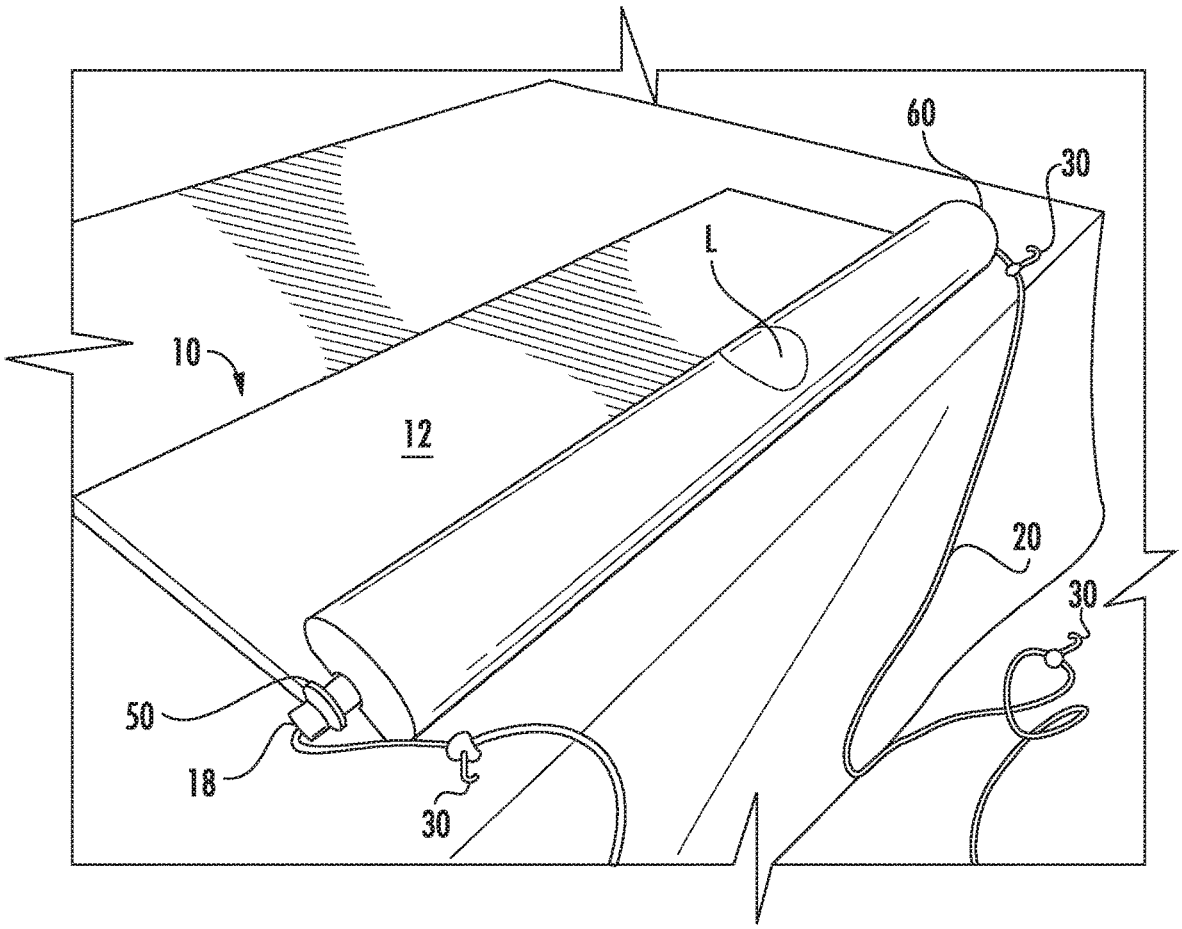
FIG. 1 is a perspective view of an embodiment of a drying device 10 in accordance with the presently disclosed subject matter.
Figure 2:
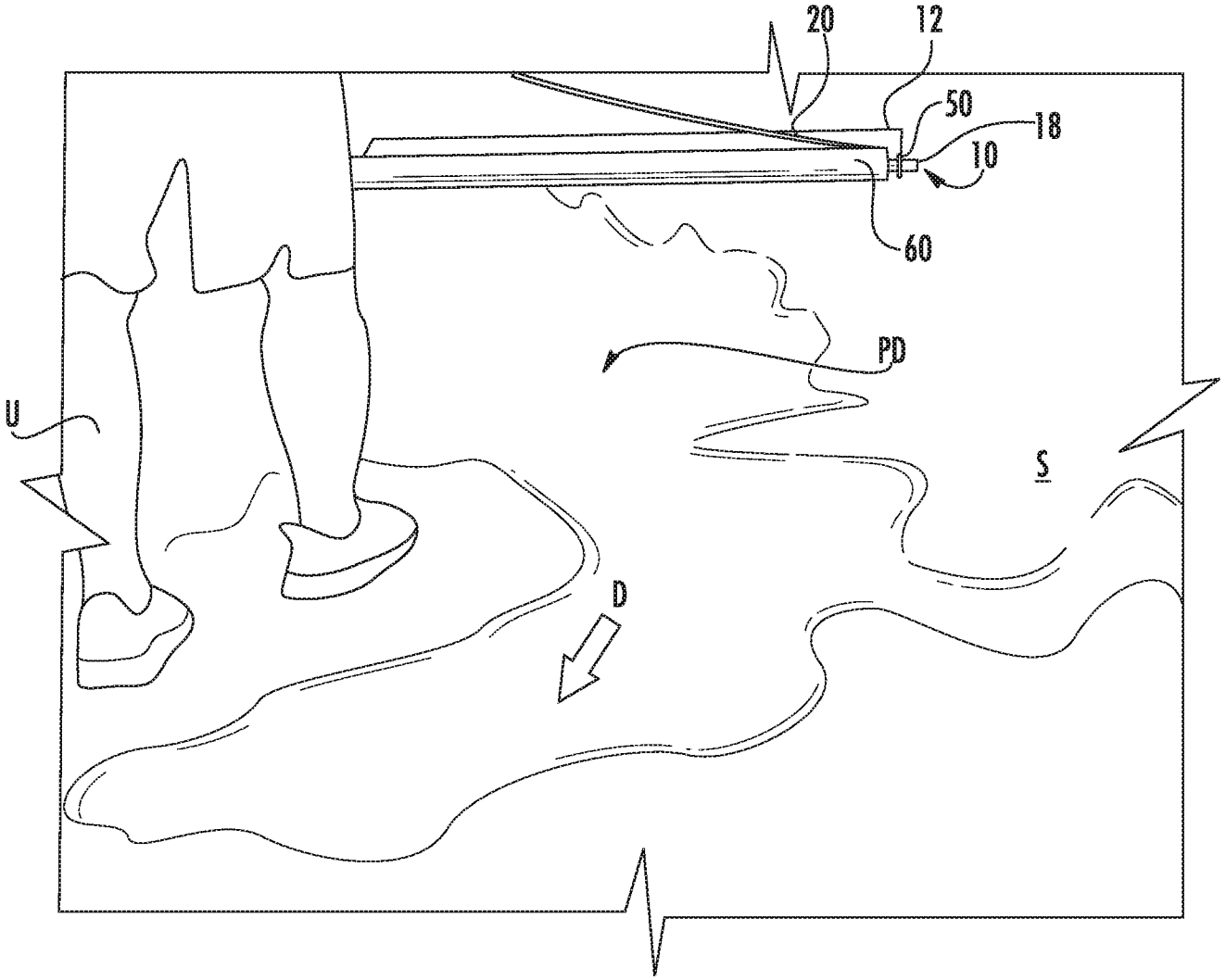
FIGS. 2, 3A, 3B, 4A and 4B show a drying device 10 in accordance with the presently disclosed subject matter in use in drying a surface S in a series of steps.
Figure 3A:
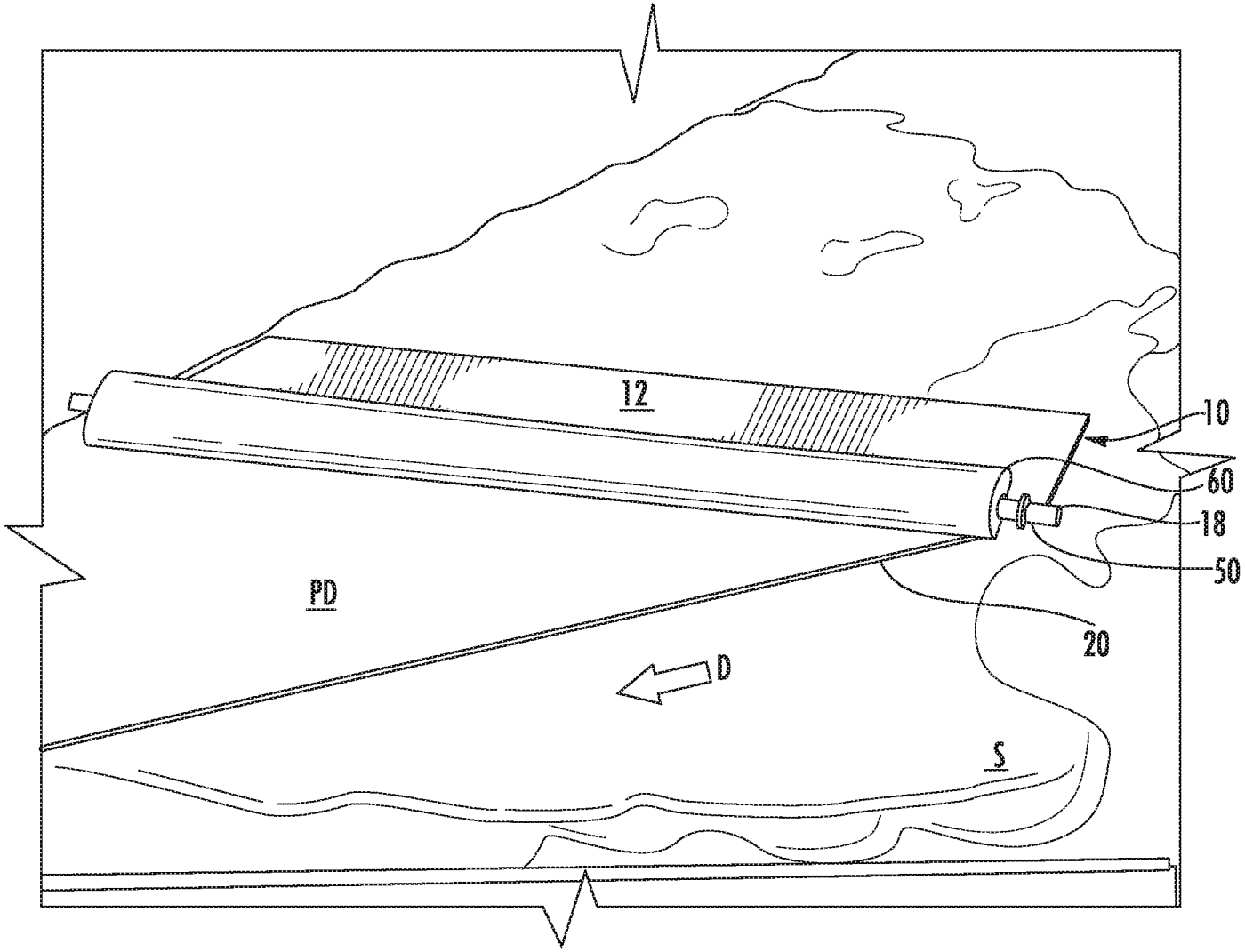
Figure 3B:
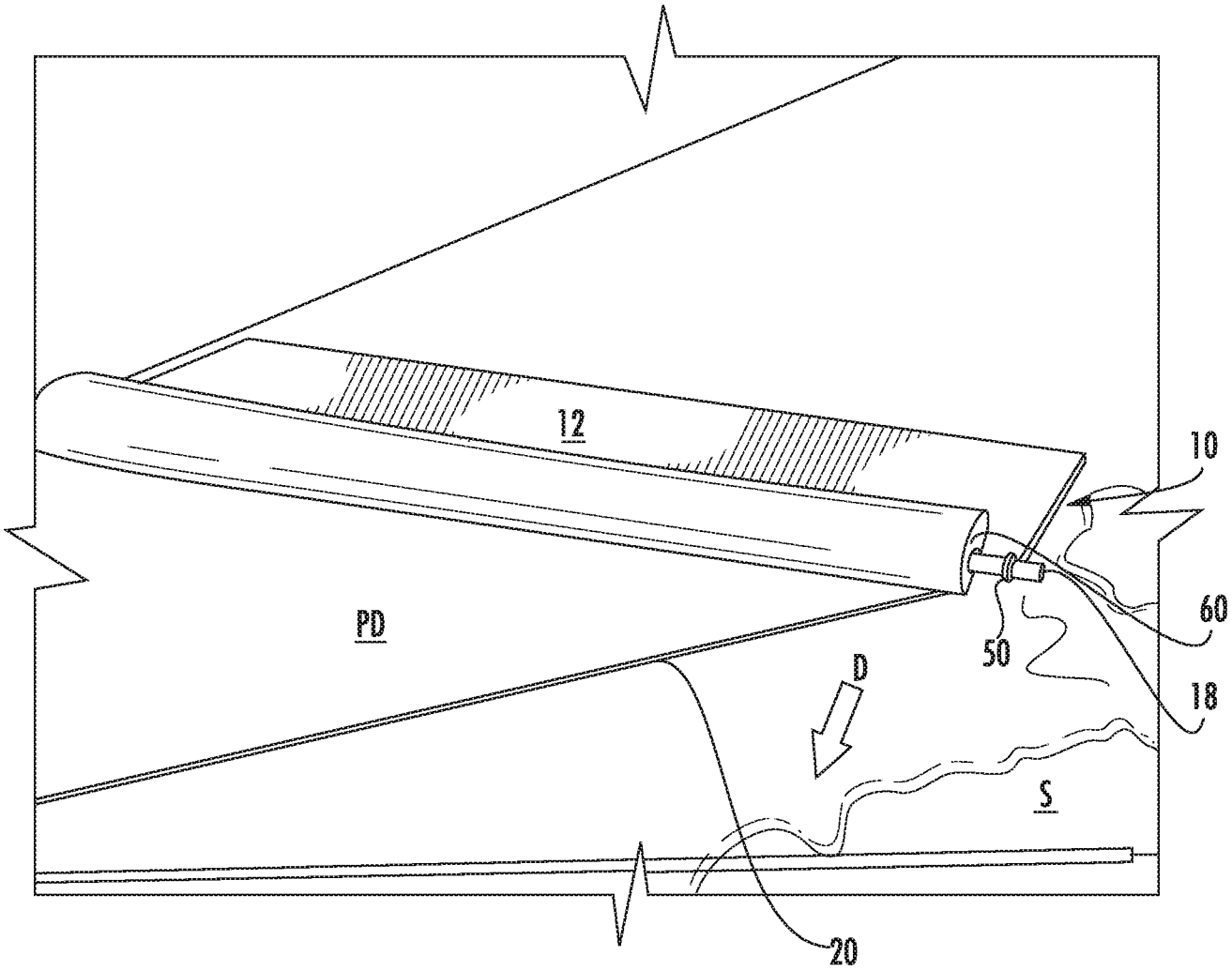
Figure 4A:
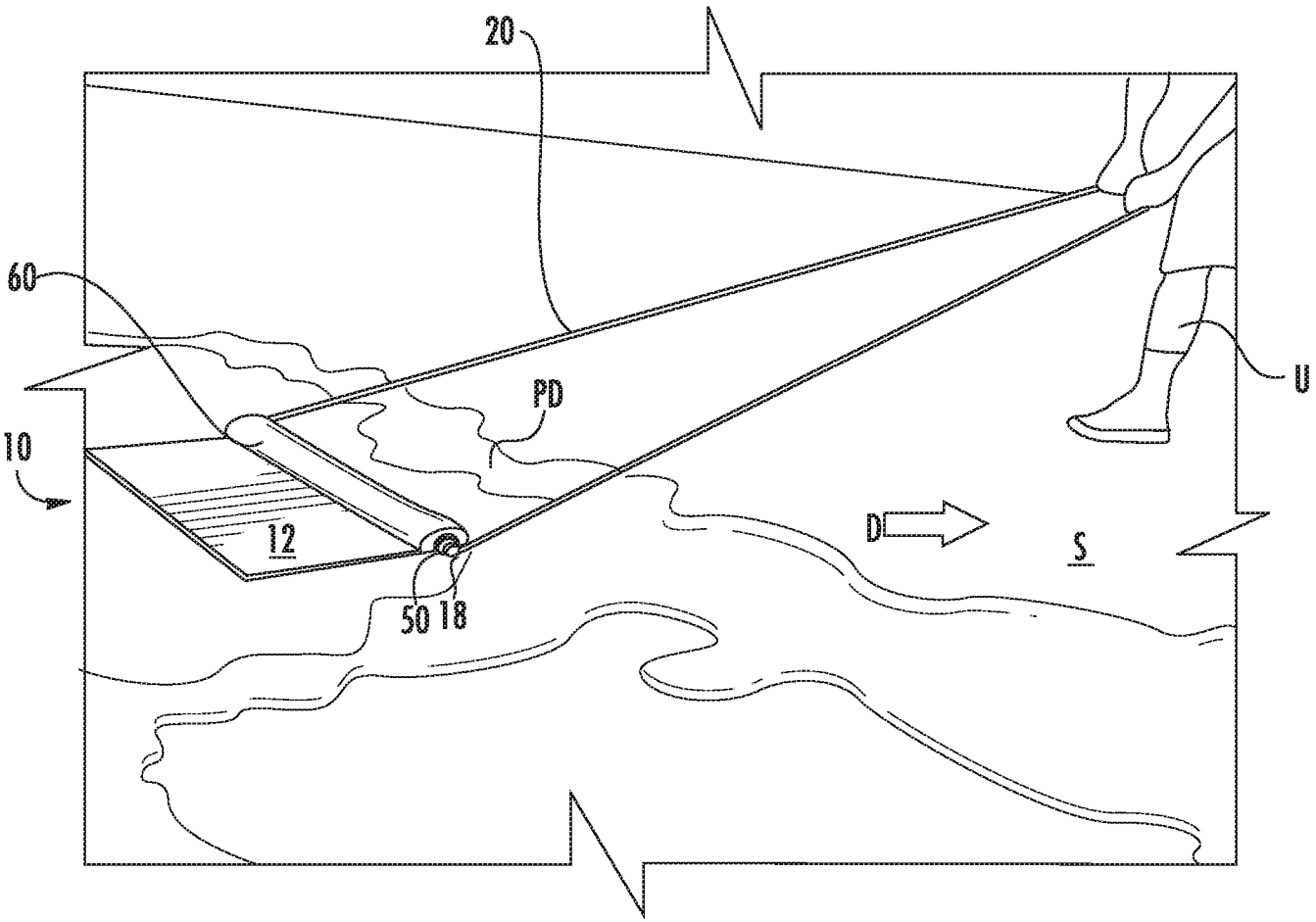
Figure 4B:
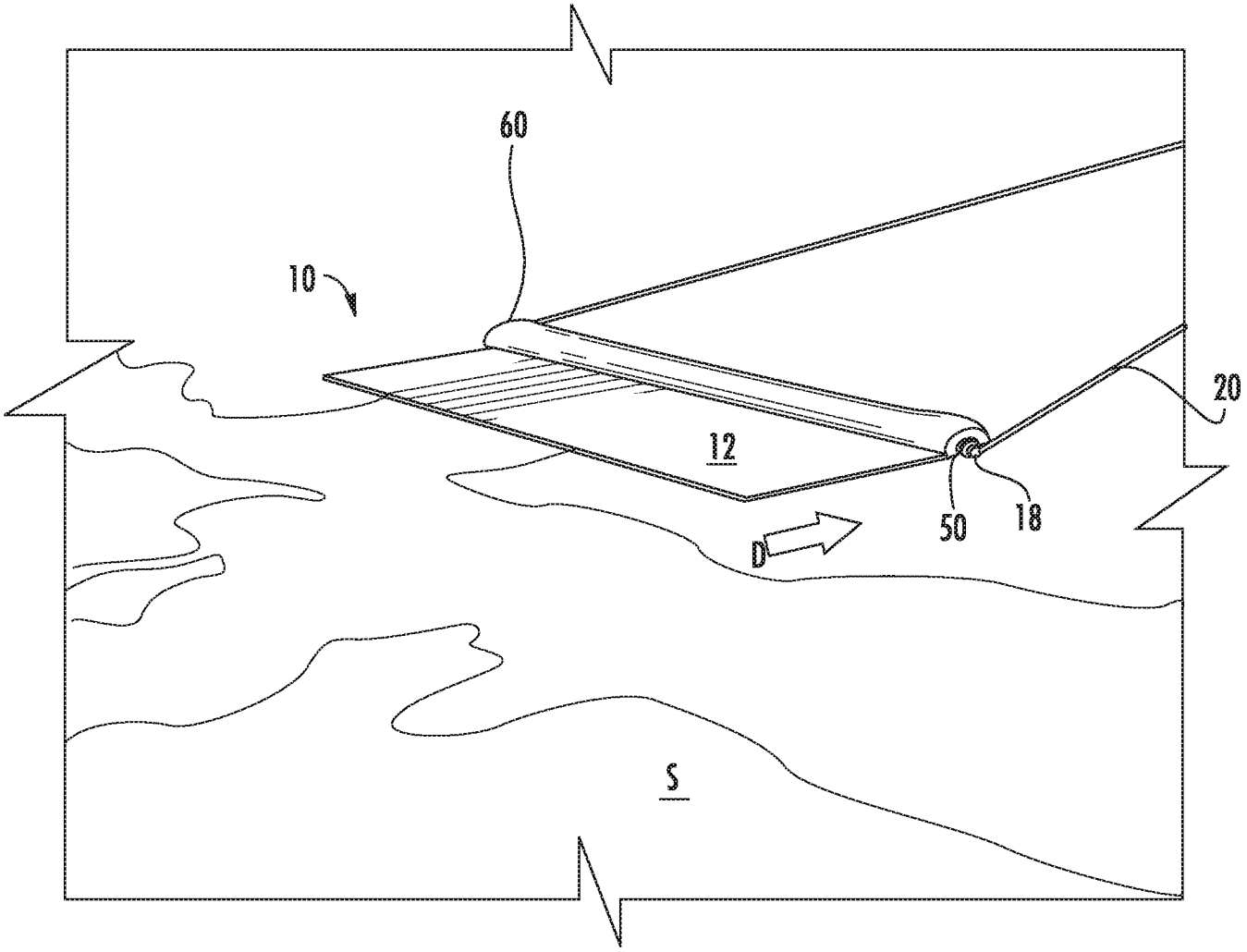
Figure 5:
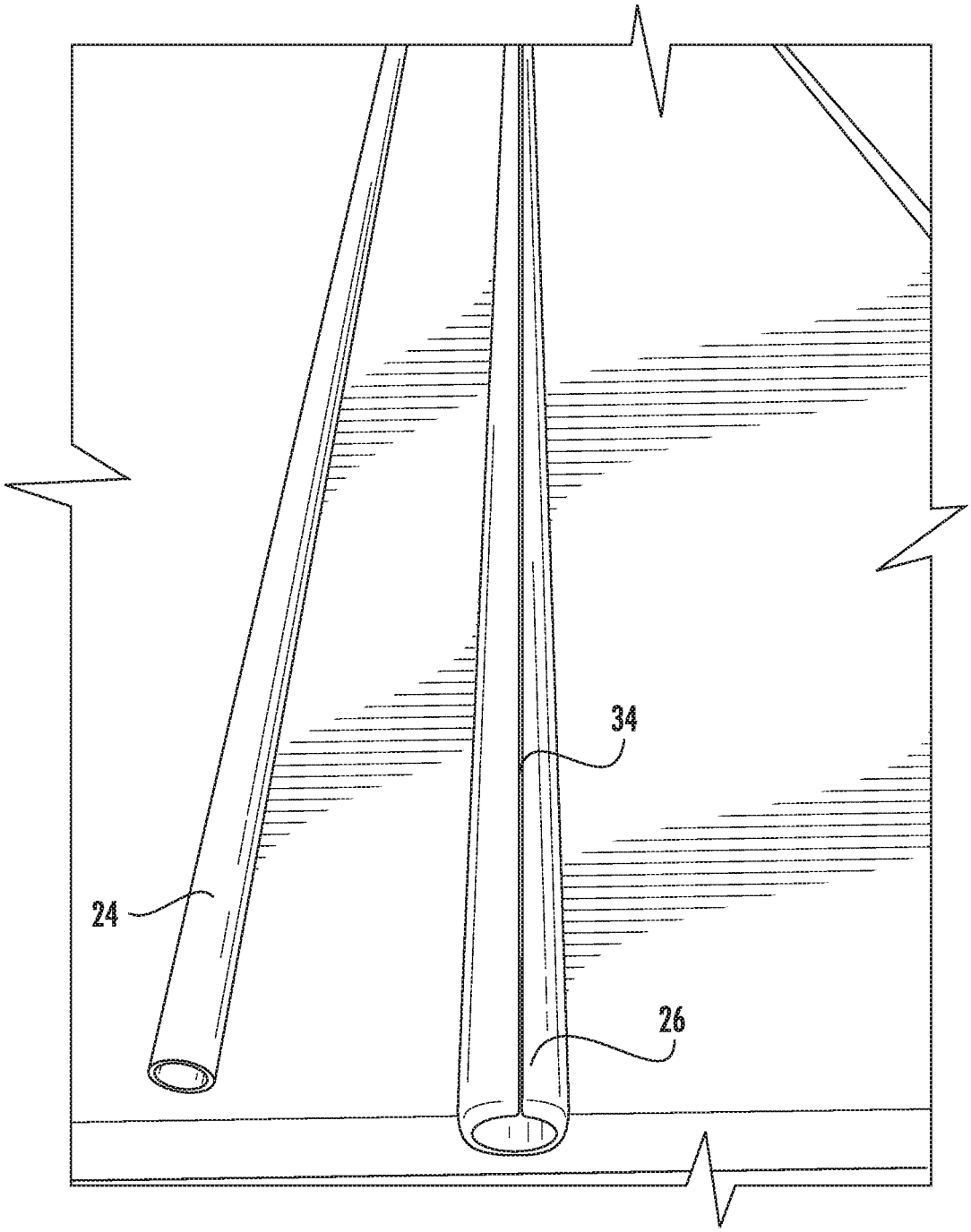
FIGS. 5-9 are perspective views showing installation of panels 12 in device 10 in accordance with some embodiments of the presently disclosed subject matter.
Figure 6:
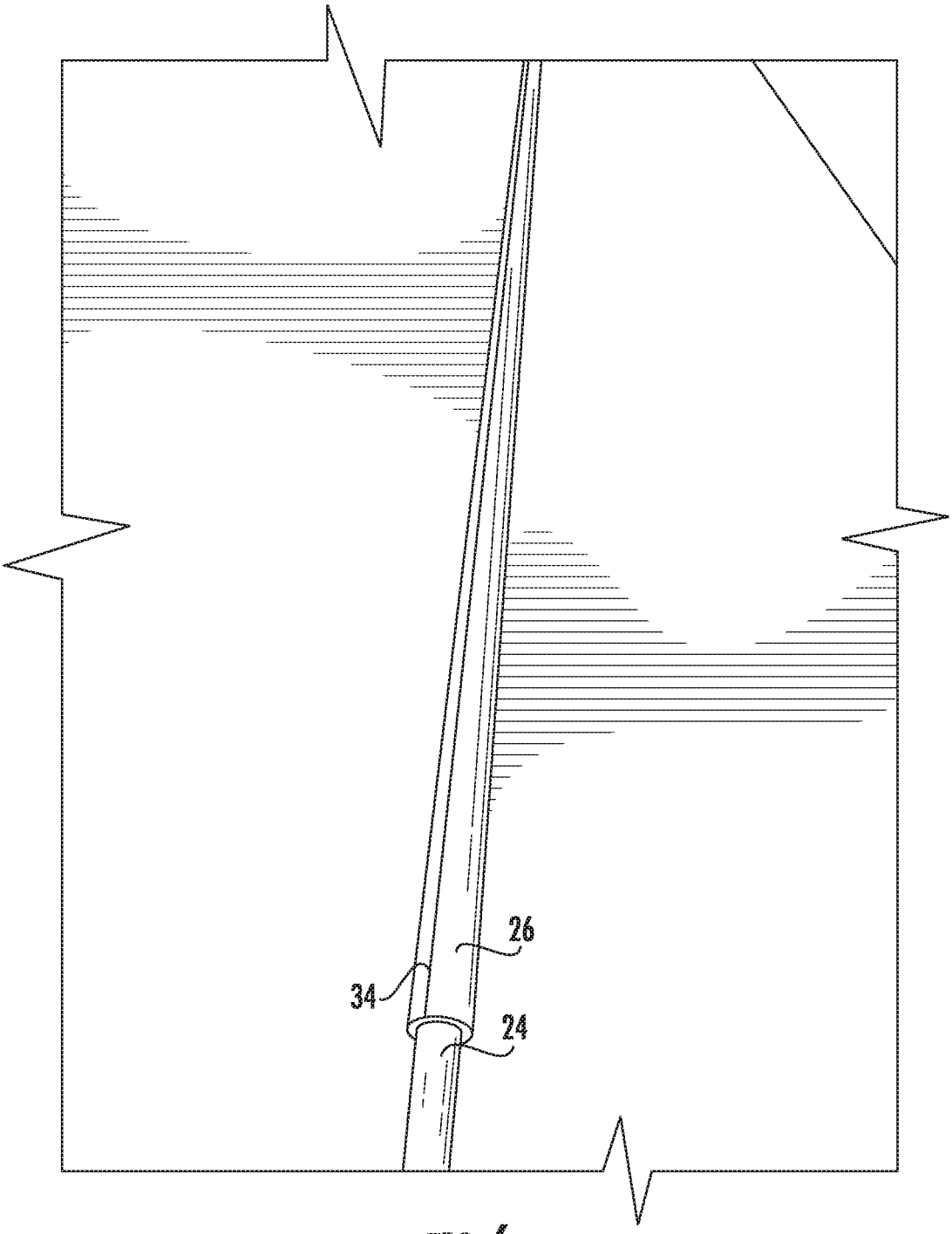
Figure 7:
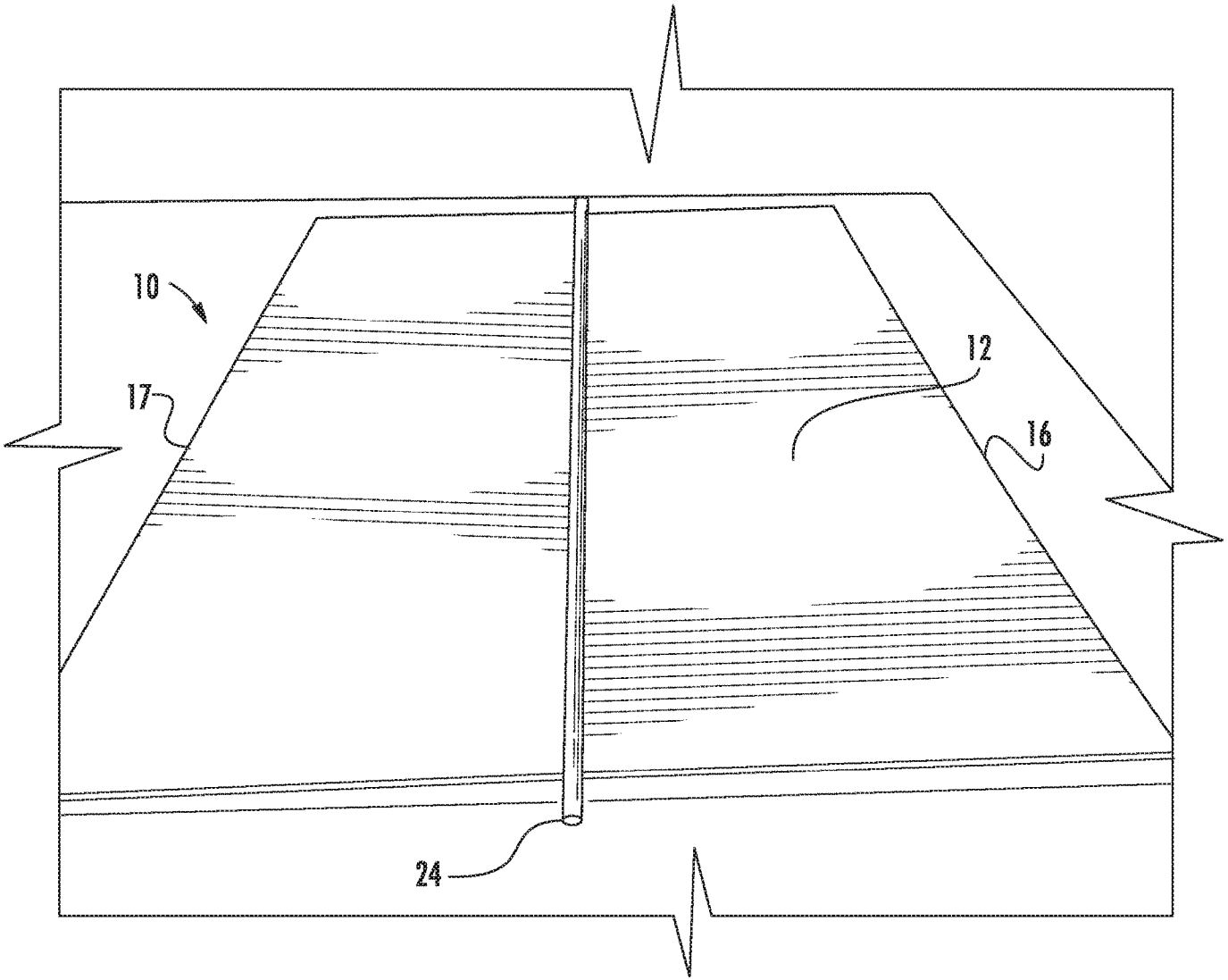
Figure 8:
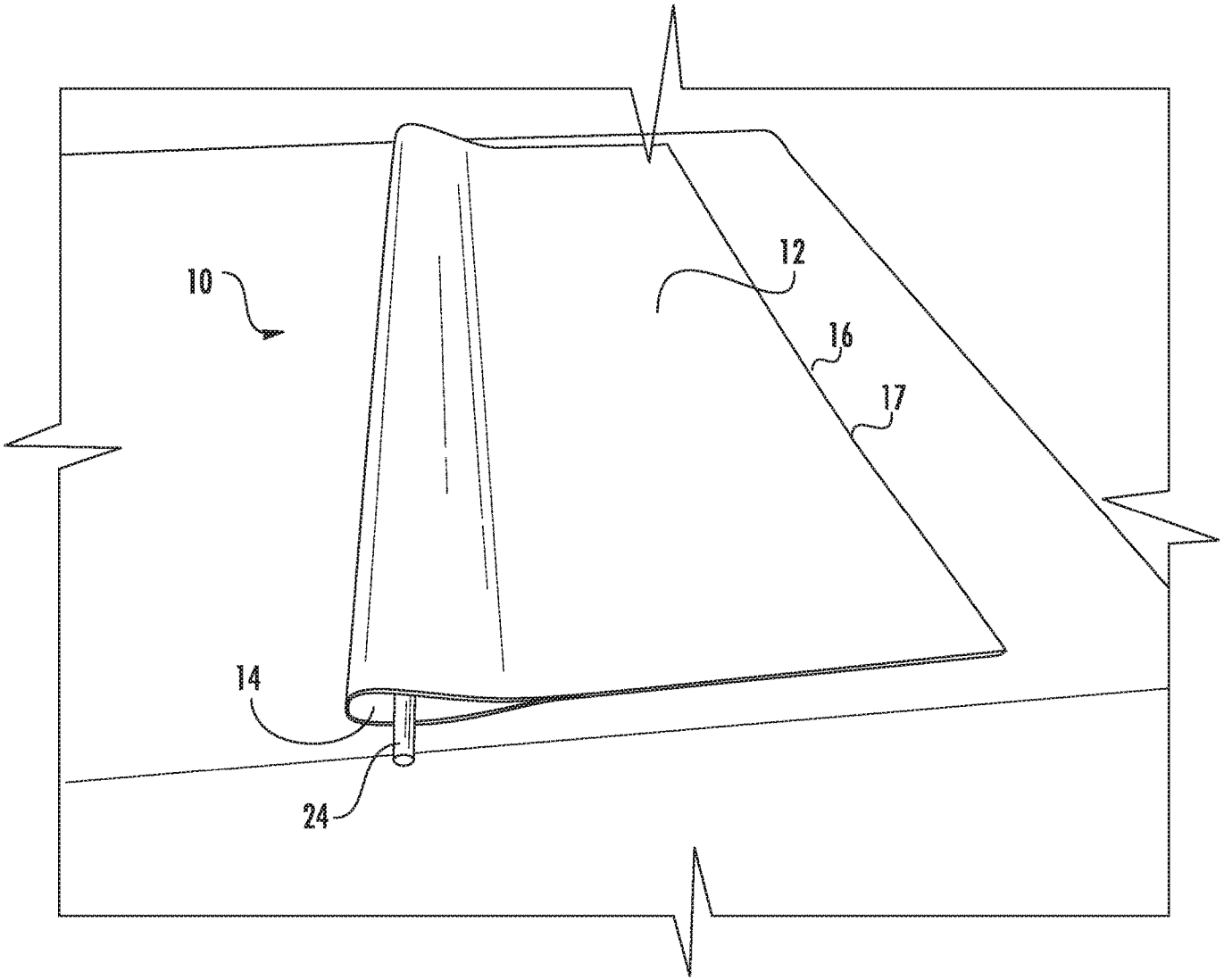
Figure 9:
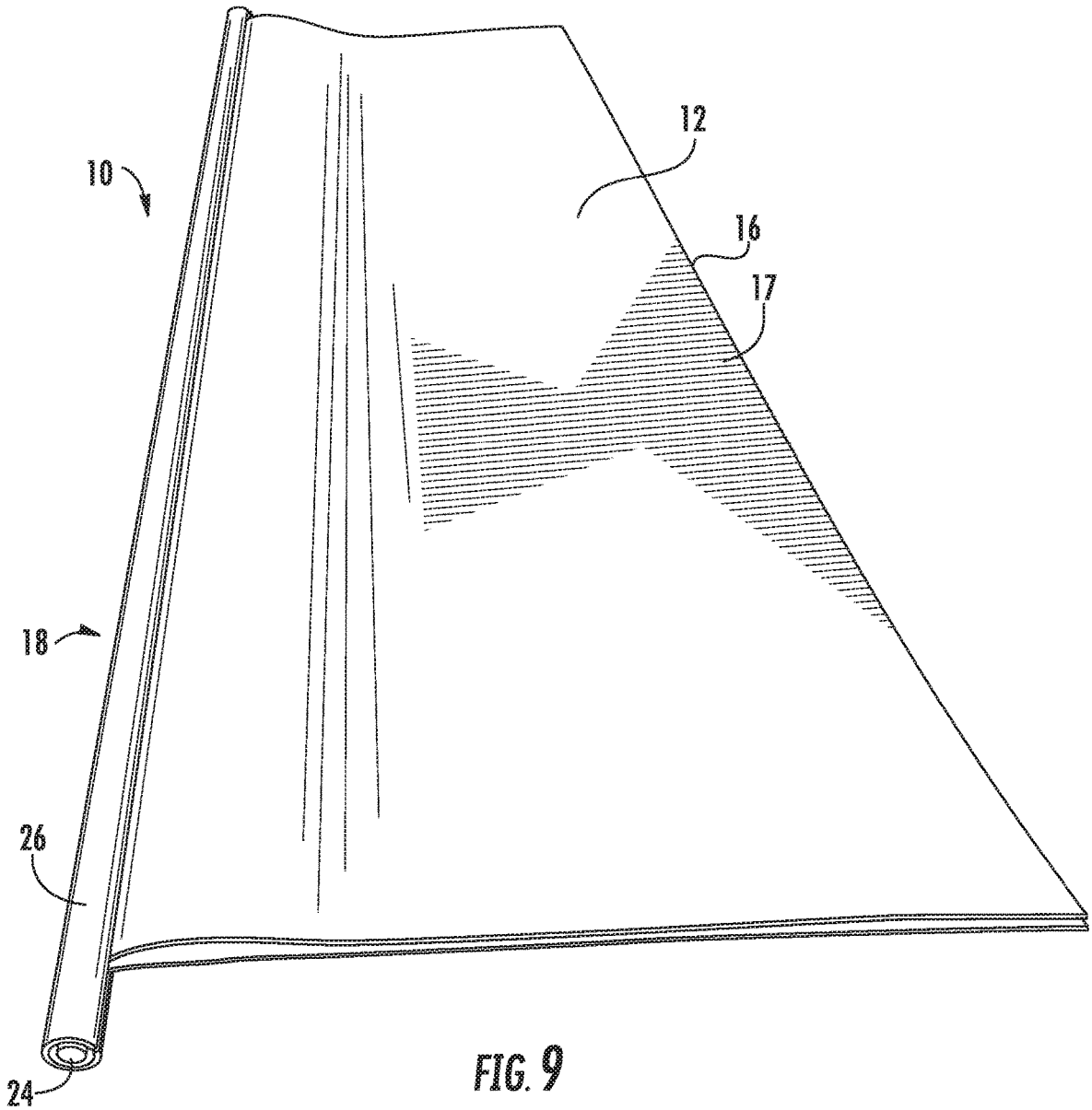

The presently disclosed subject matter relates generally to the design of a drying device and method. A full and enabling disclosure of the present subject matter including the best mode thereof to one of ordinary skill in the art is set forth more particularly in the remainder of the specification, including the accompanying Figures.

Reference will now be made in detail to the description of the present subject matter, one or more examples of which are shown in the Figures. Each example is provided to explain the subject matter and not as a limitation. In fact, features illustrated or described as part of one embodiment can be used in another embodiment to yield still a further embodiment. It is intended that the present subject matter cover such modifications and variations. The scaling of the Figures does not represent precise dimensions of the various elements illustrated therein. Moreover, references herein and in the Figures to certain particular dimensions are merely meant to be exemplify the presently disclosed subject matter and not to limit the presently disclosed subject matter.

In some embodiments, the drying device of the presently disclosed subject matter employs one or more panels. In some embodiments, the one or more panels each comprise a smart microfiber fabric. Characteristics of the microfiber fabric include that it is highly absorbent and also durable. Another characteristic of interest for the fabric is that it is flexible enough to flow along or follow the contours of the surface being dried. In some embodiments, the one or more panels are substantially rectangular. However, each of the one or more panels can be provided in any desired shape (e.g., quadrilateral, such as square or rectangular, triangular, semi-circle. elliptical), dimension (e.g., length, width and/or thickness), and/or configuration (e.g., single panel, multiple panels to provide layers of panels, side by side panels) suitable to accomplish the desired drying of surface. A representative commercially available smart microfiber fabric is a product available under the registered trademark of EVOLON® from Freudenberg Spunweb of Durham, N.C., United States of America. However, any highly absorbent and durable fabric as would apparent to one of the ordinary skill upon a review of the instant disclosure can be employed. A characteristic of the EVOLON® material is that it comprises a pulverized plastic and thus other materials comprising pulverized plastic can also be considered for implementation in the presently disclosed drying device.

Referring now to the Figures, wherein like reference numerals refer to like parts throughout, an embodiment of a drying device in accordance with the presently disclosed subject matter is generally referred to at 10. Device 10 can be referred to as a BATT™ (big absorbent tennis towel) device, which is used to spread and remove water or other liquids from a hard court surface (e.g., tennis or basketball court). Referring to FIGS. 1-17, device 10 comprises one or more panels 12, which is/are adapted to be dragged across a flat surface. As discussed above, in some embodiments the one or more panels 12 comprise a microfiber fabric that is both absorbent and durable. In some embodiments, panel 12 can be of length and width dimensions that are sufficiently large to spread a puddle on a surface to be dried so that the puddle dries quickly. Representative, non-limiting dimensions include 5 feet in width and 9 feet in length. Additional representative, non-limiting dimensions can include 42 inches in length (or 84 inches, folded in half and mounted in pipe assembly 18 as described elsewhere herein) and 56 inches in width.

Continuing with reference to FIGS. 1-17, drying device 10 further comprises a sleeve 14 defined by panel 12. In some embodiments, sleeve 14 is provided by folding over (such as folding in half or folding over a shorter portion, such as 2 inches) and stitching end 16 to panel 12, which provides a seam. In some embodiments, the sleeve 14 is not stitched; rather, panel or panels 12 is/are looped in half over pipe 24 so that each end 16, 17 of panel or panels 12 line up with each other and sleeve 14 is formed. See FIGS. 5-9. Sleeve 14 is adapted to receive and receives a conduit pipe assembly 18, which further receives rope 20. Sleeve 14, pipe assembly 18 and/or rope 20 act as a handle that is employed by a user of device 10 in dragging device 10 across a surface as shown in FIGS. 2 through 4B. In some embodiments, the one or more panels 12 is/are substantially as wide as the handle, but this does not have to be the case. For example, the one or more panels 12 can be narrower than the pipe assembly 18 that forms part of the handle.

Continuing with reference to FIGS. 1-17, conduit pipe assembly 18 can comprise a pipe 24 (such as a metal pipe, such as a ½"×5' metal pipe) inside another pipe 26, which can be a PVC pipe (such as a 1"×5' PVC pipe). PVC pipe 26 has a slit 34 cut through it for its entire length. Sleeve 14/metal conduit pipe 24 is threaded through PVC pipe 26, creating an encasement for sleeve 14 and a strong frame from which to support the one or more panels 12. Continuing with particular reference to FIGS. 7-9, as noted above in some embodiments, a series of panels 12 are looped over pipe 24 and held in place by pipe 26. This installation facilitates the changing of panels 12 when they become soiled and/or worn out, so that they can be washed and/or replaced. Also, it facilitates the user's ability to flip to different surfaces of panels 12 so that a new or clean surface of panels 12 can be applied to the surface to be dried. That is, a user can rotate panels 12 about pipe assembly 18 to provide for a different panel 12 to be in contact with the surface to be cleaned, depending on the state of cleanliness and/or wear of a particular panel 12.

End caps 22 (which can also be PVC) are placed on the ends of pipe assembly 18 to help keep the pieces together and to raise pipe assembly 18 off the ground to protect it from the abrasion of the hard court. Rope 20 (which can be any desired length and/or material, such as but not limited to a 25' piece of ⅜" nylon rope) is threaded through pipe assembly 18 and tied off at the ends, and/or otherwise secured to pipe assembly 18, for example at the ends of pipe assembly 18, such as via one or more screws, to be used as a handle or pulling mechanism for device 10. A hook (shown at 30 in FIGS. 1, 11, 12 and 14), which can be a coffee hook and optionally rubber coated, is connected to (such as by being screwed in) each end of pipe assembly 18 and/or at one more points along rope 20 (see FIG. 1) such as via a knot or loop in rope 20 to create the ability to hang device 10, such as from a wind screen or a fence. In some embodiments, panel 12 can be folded onto hooks 30 using holes in device 10 to make device 10 shorter while hanging on the fence. Hooks 30 can be prepared in any desired way as would be apparent to one of ordinary skill in the art upon a review of the present disclosure. As a representative approach, hooks 30 are made by welding an I-hook onto a piece of rough wire, and one segment of hook 30 can be attached to the wind screen or fence while another segment of hook can support device 10 when it is folded for storage. Hooks 30 can also be S-hooks.

Figure 10:
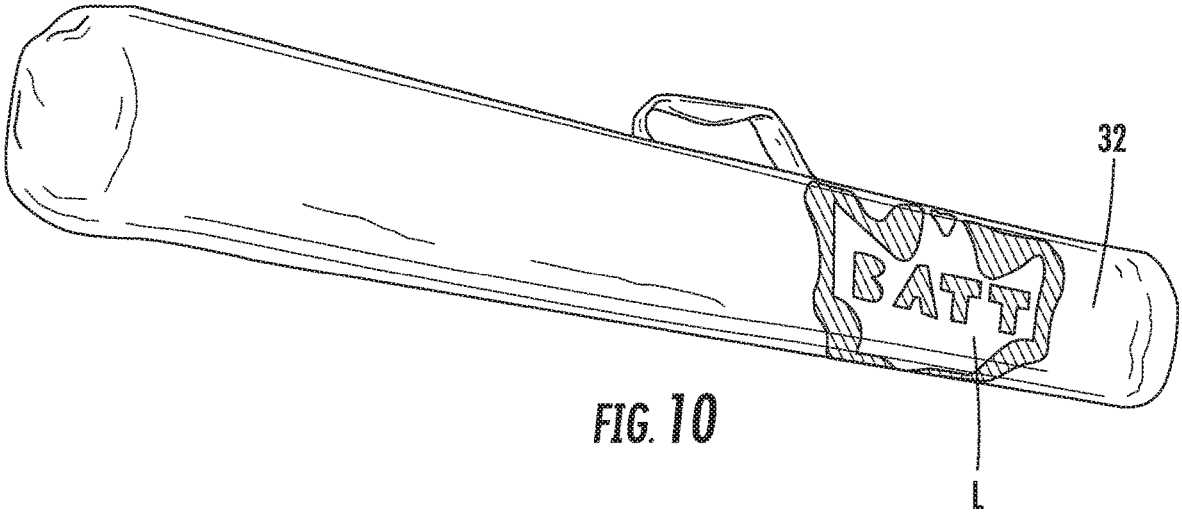
FIG. 10 is a perspective view of a drying device in accordance with the presently disclosed subject matter presented in a carrying case.
Figure 11:
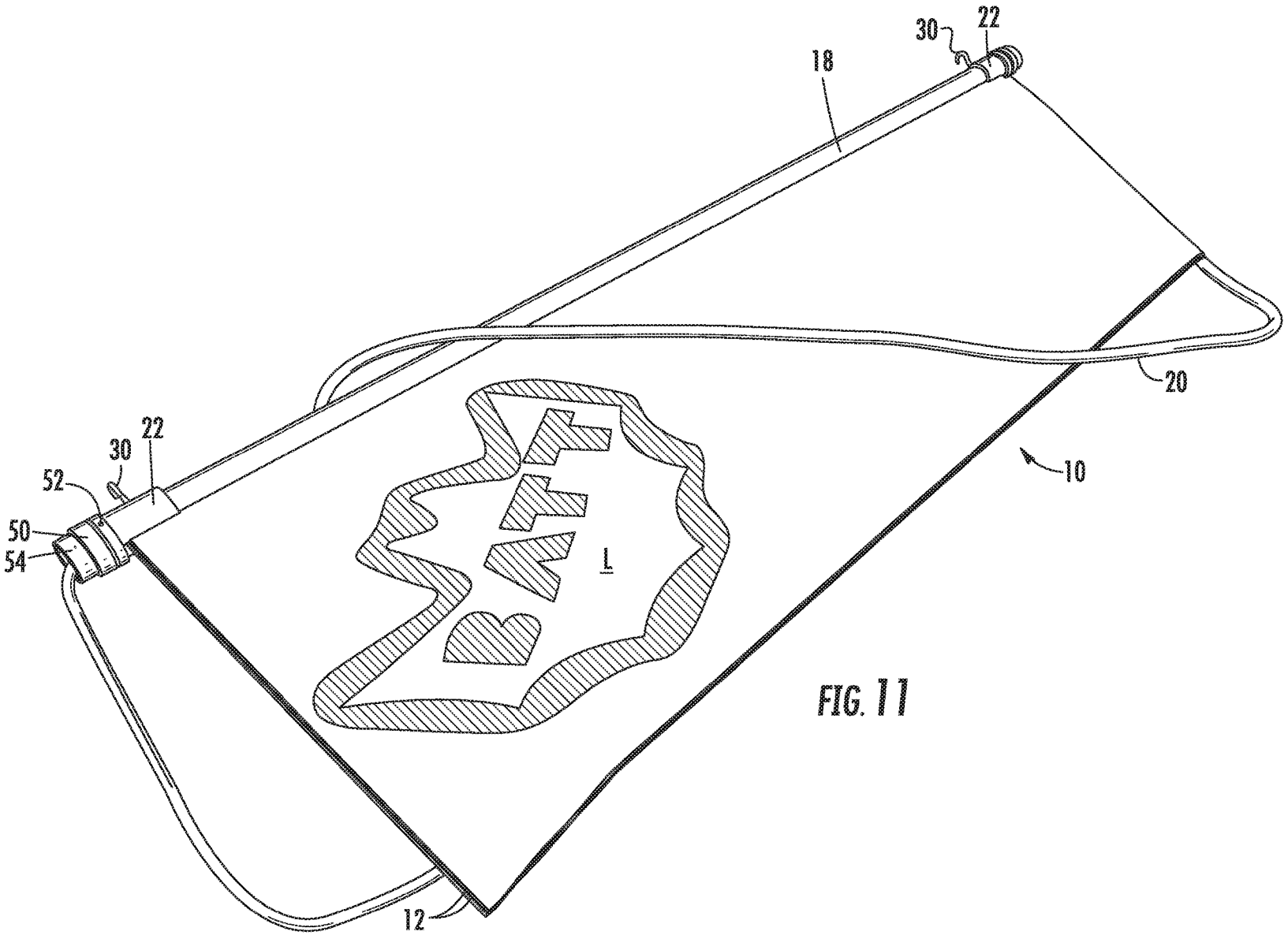
FIG. 11 is a perspective view of another embodiment of a drying device 10 in accordance with the presently disclosed subject matter.
Figure 12:
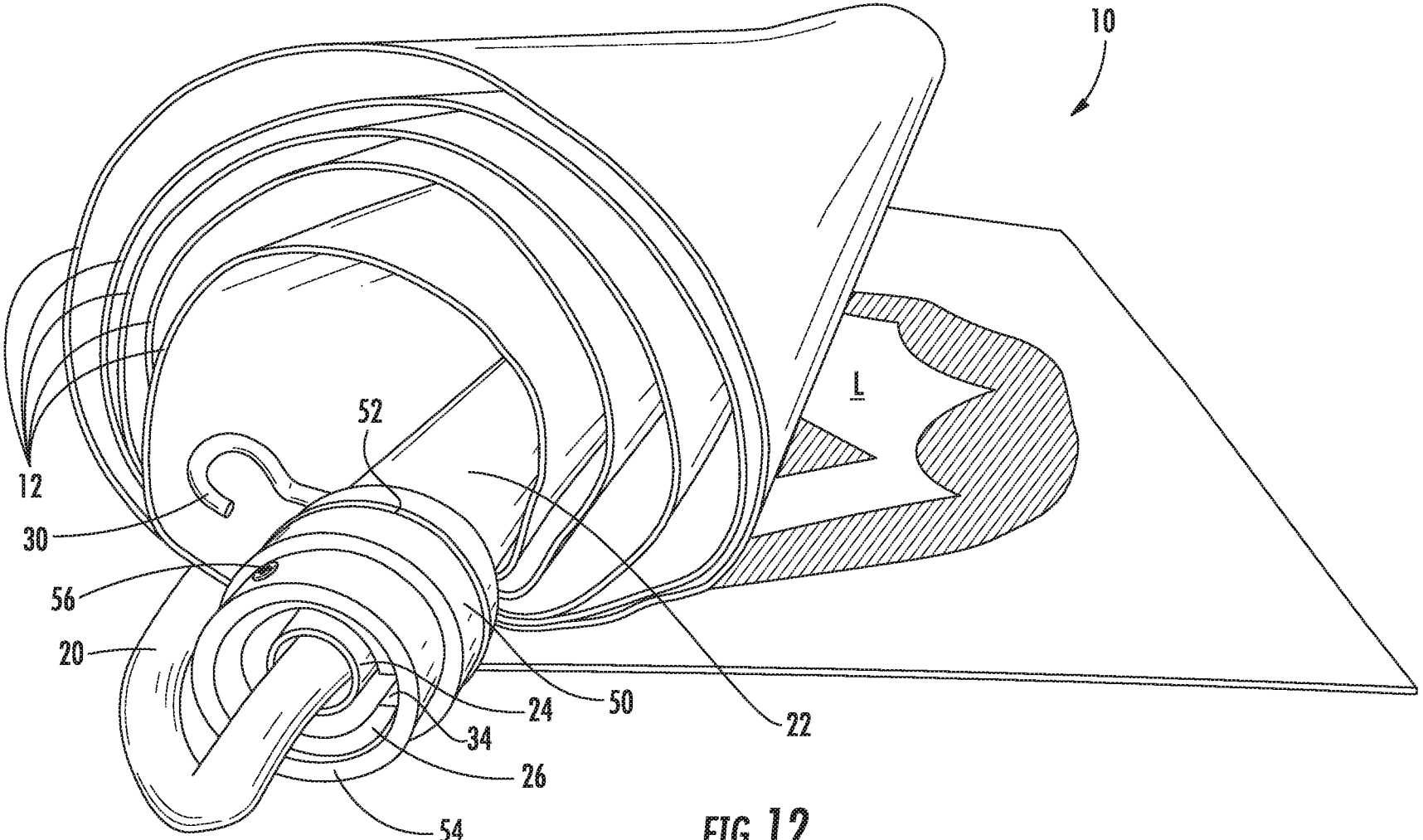
FIG. 12 is a side view of an embodiment of a drying device 10 in accordance with the presently disclosed subject matter as shown in FIG. 11.
Figure 13:
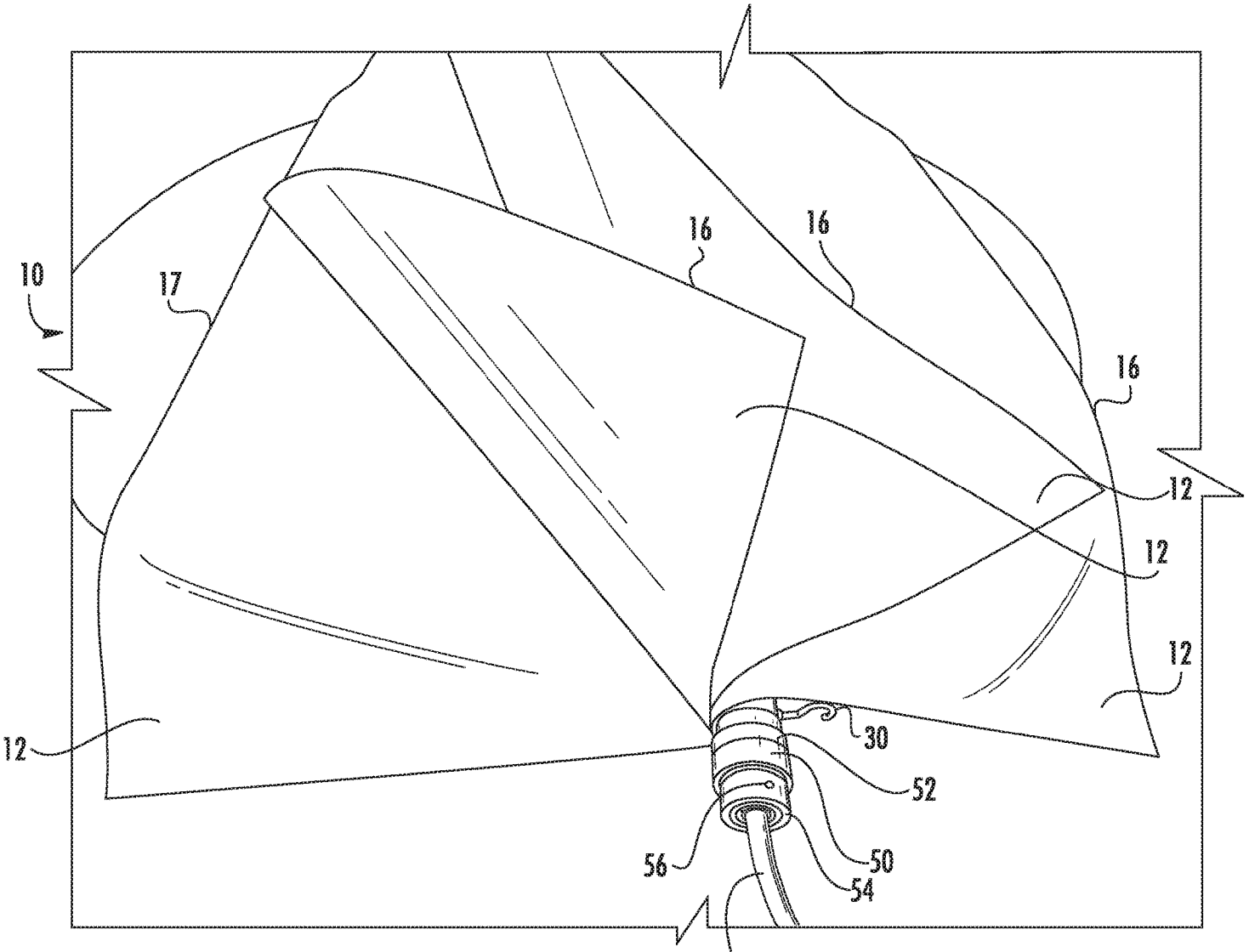
FIG. 13 is a perspective view of an embodiment of a drying device 10 in accordance with the presently disclosed subject matter as shown in FIG. 11 wherein panels 12 are fanned out.
Figure 14:
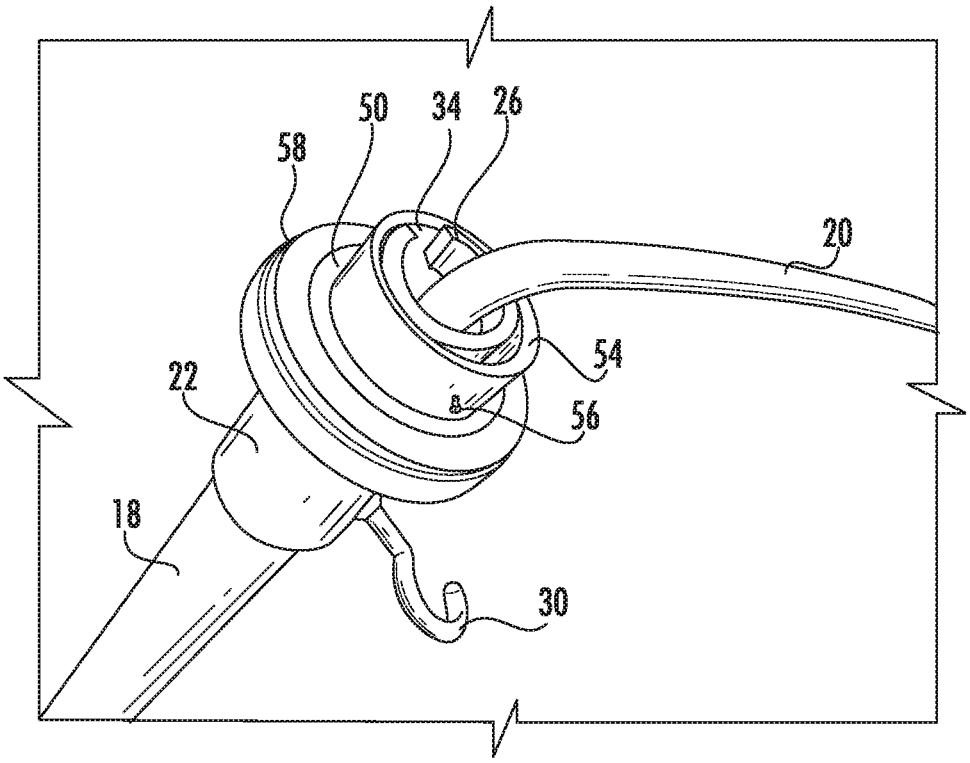
FIG. 14 is a perspective view of an embodiment of a drying device 10 in accordance with the subject matter showing wheels 50.
Figure 15:
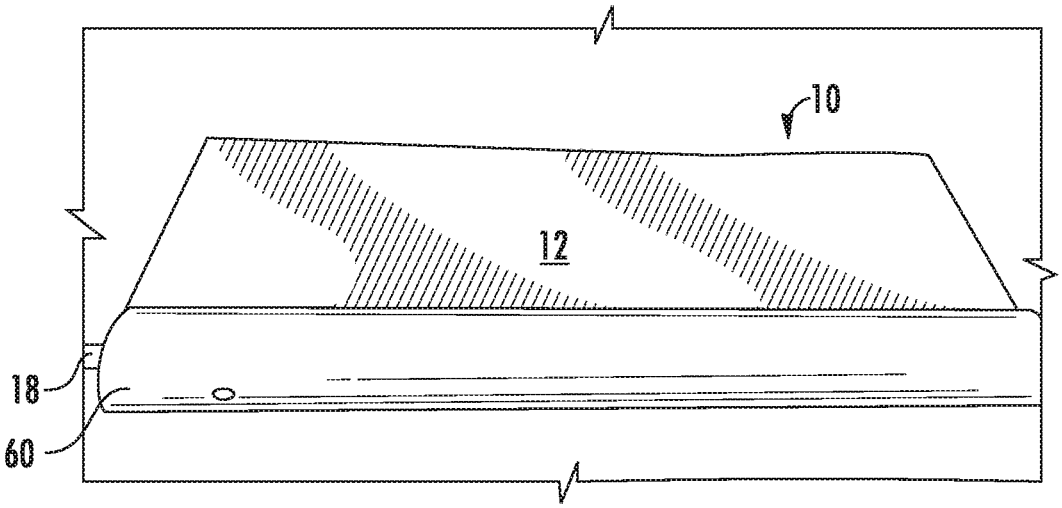
FIG. 15 is a perspective view of another embodiment of a drying device 10 in accordance with the presently disclosed subject matter, comprising scraper 60.
Figure 16:
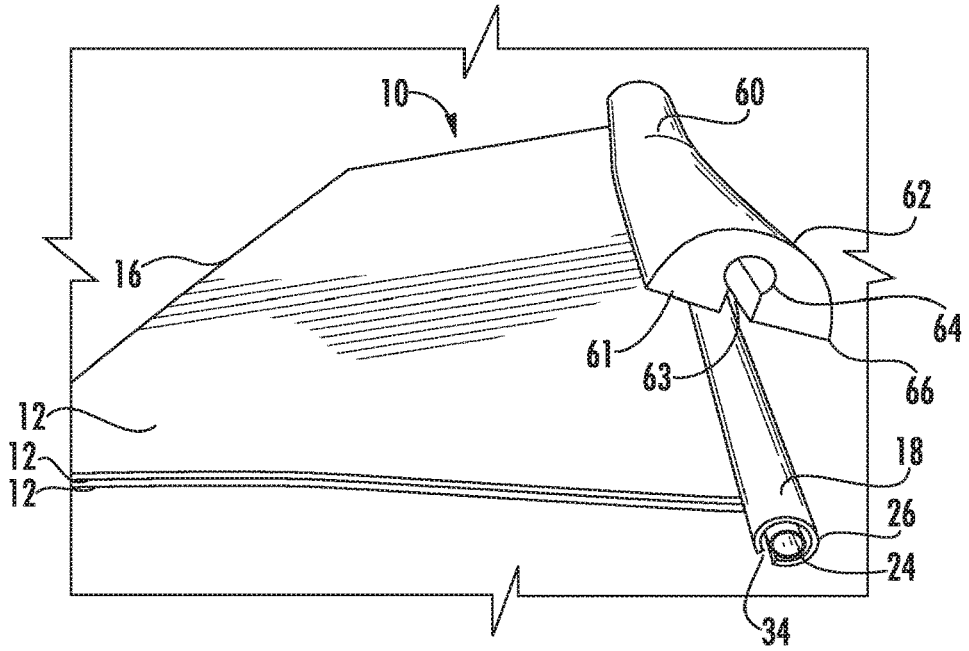
FIG. 16 is a side view of an embodiment of a drying device in accordance with the presently disclosed subject matter as shown in FIG. 15.
Figure 17:
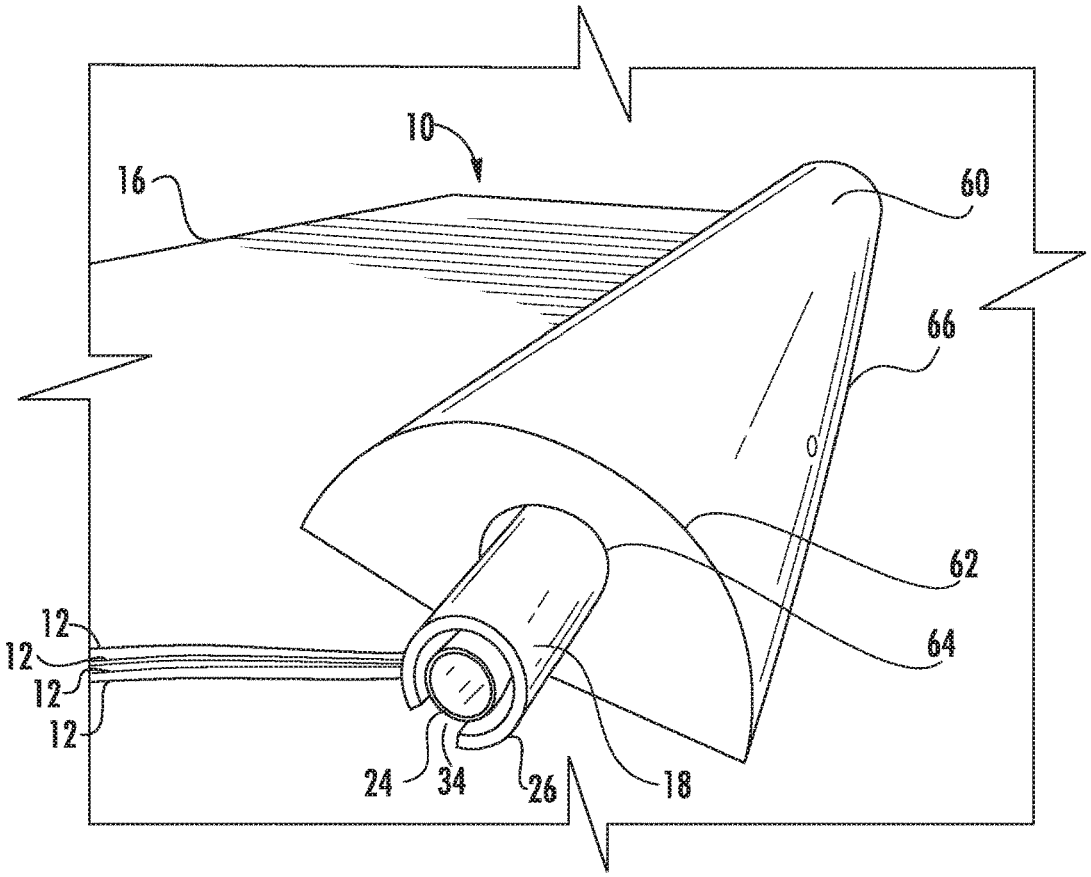
FIG. 17 is a close-up side view of an embodiment of a drying device 10 in accordance with the presently disclosed subject matter as shown in FIG. 15.

As best seen in FIG. 10, a tote bag 32, which can also be made from a microfiber fabric such as EVOLON® microfiber fabric, is used to store and carry device 10. Tote bag 32 can also include a logo L.

In some embodiments, an end cap cover can be employed. In some embodiments, an end cap cover (which can be any suitable or desired size and/or material, such as but not limited to a 2 inch PVC segment that is 1¼ inches in diameter) slides over the other end caps 22 and can be rotated when there is wear on end caps 22. For example, an end cap cover can be rotated in ¼ turns and screwed via screw down every time there is advanced wear on end cap 22. This can help extend the life of end caps 22 and thusly the whole device 10.

Referring particularly to FIGS. 11 through 14, another embodiment of device 10 of the presently disclosed subject matter is shown. In this embodiment of device 10, multiple panels 12 are attached to pipe assembly 18, such as by looping over pipe 24 to be mounted within pipe assembly 18 so that their ends 16, 17 line up, as discussed herein above. In this embodiment, the width of each panel 12 is similar to the width in other embodiments, but the length of each panel 12 is shorter. For example, the length can be approximately 2 feet (or 4 feet before looping) or other conveniently short length. Again, a plurality of panels 12 are provided and facilitate drying of a surface through absorption of liquid(s) through the multiple layers. To elaborate, in this embodiment panels 12 define multiple layers which lie on top of each other when in use. The weight of the layered panels 12 presses down on the surface to facilitate absorption of liquid from the surface and to provide for the drying of the surface. In some embodiments there are eight panels 12. Indeed, device 10 can include one, two, three, four, five, six, seven, eight, or more panels 12, depending on the desired end use. The multiple layered panels 12 are entrapped within device 10 as described hereinabove with regard to device 10 with a single panel 12. In some embodiments panels 12 are all the same length and width, so that when they rest on the surface they all lie substantially on top of each other. In some embodiments the length and/or width of panels 12 can vary so as to create a tapering effect if desired in either direction, widthwise or lengthwise.

Continuing with particular reference to FIGS. 1, 12, 13 and 14, device 10 can further comprise wheels 50 mounted to pipe assembly 18 so as to engage and roll along a surface. Wheels can be mounted at each end of pipe assembly 18 by any approach as would be apparent to one of ordinary skill in the art upon a review of the instant disclosure, such as via frictional mounting and/or by one or more screws into pipe assembly 18 adjacent to wheel 50, such as between wheel 50 and the end of pipe assembly 18. In some views in the Figures only one end of pipe assembly 18 can be seen. In some embodiments, wheels 50 are mounted between end cap 22 and end ring 54. End ring 54 is secured to pipe assembly 18 by screws 56. In some embodiments wheels 50 are simply rings or rims; but can also include a rubber washer 52 or tire 58 or other suitable structure to facilitate rolling along a surface.

Referring now to FIGS. 1-4B and 15-17, device 10 can further comprise a scraper 60 that can be snapped onto pipe assembly 18 or otherwise mounted on pipe assembly 18. In some embodiments, scraper 60 is adapted to engage a surface to be dried when device 10 is in use. For example, scraper 60 can pivot about pipe assembly 18 to engage a surface to be dried. Thus, scraper 60 can be used as a "squeegee" in that the front edge 66 of scraper 60 engages into the court surface and carries or pushes water out in front, spreading the water over a greater surface area and creating a dryer court quickly. Thus, in some embodiments, scraper is adapted to engage a surface to be dried when the drying device is in use. In some embodiments the weight of panel or panels 12 and/or resistance of panel or panels 12 as it is/they are dragged across a surface to be dried act as a counterbalance to drive scraper 60 to engage the surface to be dried.

In some embodiments, scraper 60 can comprise a generally semi-circular cross section 62 and a notch 64 adapted to receive pipe assembly 18. In some embodiments, notch 64 is generally circular, with a rectangular opening 63 at a lateral edge 61 of scraper 60. Representative dimensions for scraper 60 include 54 inches wide and 5.6250 inches high. Cross section 62 can have as a representative, non-limiting dimension a radius of 2.813 inches. Notch 64 can have as representative, non-limiting dimensions a diameter of 1.375 inches and a center approximately 0.75 inches from a lateral edge 61 of scraper 60. Rectangular opening 63 of notch 64 can have as representative, non-limiting dimensions a width of 0.75 inches and a height from edge 61 of 0.25 inches. However, these are representative dimensions only and are not meant to limit the presently disclosed subject matter. Further, scraper 60 can comprise a cross-linked polyethylene material. However, this is just one non-limiting example of a suitable material. Indeed, scraper 60 can comprise any suitable material as might be apparent to one of ordinary skill in the art upon a review of the instant disclosure. A rope 20 and wheels 50 can be mounted to pipe assembly 18 as described herein above, in embodiments where scraper 60 is implemented.

Referring now to FIGS. 2 through 4B a method of drying a surface using drying device 10 is shown. Particularly, a user U drags device 10 across a surface S that includes puddles PD. User U deploys device 10 adjacent to a puddle PD by placing scraper 60 and one or more panels 12 across surface S. User U then grasps rope 20 and slightly lifts pipe assembly 18 and proceeds to drag device 10 across surface S toward puddles PD. User U continues in a direction D such that device 10 is dragged through puddles PD until the liquid that makes up puddles PD is absorbed into one or more panels 12 and/or is spread across surface S. In this way, the drying of surface S is readily accomplished through absorption of the liquid from the puddle PD and also the spreading of the liquid across surface S so that it can more rapidly dry by exposure to the air. As shown in FIGS. 2 through 4B, user U continues in direction D until the desired portions of surface S are dried using device 10. User U can repeatedly pull device 10 across surface S as often as needed to dry surface S to a sufficient or desired degree.

In FIGS. 2 through 4B surface S is an outdoor tennis court. However, the drying of any outdoor hard court surface, such as a basketball court, is also provided in accordance with the presently disclosed subject matter.

The present disclosure also provides any and all articles, uses, kits, devices, systems, apparatuses, and/or methods shown and/or described expressly or by implication in the information provided herewith, including but not limited to features that may be apparent and/or understood by those of skill in the art.

While the following terms are believed to be well understood by one of ordinary skill in the art, the following definitions are set forth to facilitate explanation of the presently disclosed subject matter.

Following long-standing patent law convention, the terms "a", "an", and "the" refer to "one or more" when used in this application, including the claims.

Unless otherwise indicated, all numbers expressing quantities of size, weight, percentage, temperature or other reaction conditions, and so forth used in the specification and claims are to be understood as being modified in all instances by the term "about". Accordingly, unless indicated to the contrary, the numerical parameters set forth in this specification and attached claims are approximations that can vary depending upon the desired properties sought to be obtained by the presently disclosed subject matter.

As used herein, the term "about", when referring to a value or to an amount of size, weight, concentration, temperature, percentage, or the like is meant to encompass variations of, in some embodiments ±20%, in some embodiments ±10%, in some embodiments ±5%, in some embodiments ±1%, and in some embodiments ±0.1% from the specified amount, as such variations are appropriate to perform the disclosed methods.

The use of the term "or" in the claims is used to mean "and/or" unless explicitly indicated to refer to alternatives only or the alternatives are mutually exclusive, although the disclosure supports a definition that refers to only alternatives and "and/or." As used herein "another" can mean at least a second or more.

As used herein, the term "and/or" when used in the context of a listing of entities, refers to the entities being present singly or in combination. Thus, for example, the phrase "A, B, C, and/or D" includes A, B, C, and D individually, but also includes any and all combinations and subcombinations of A, B, C, and D.

The term "comprising", which is synonymous with "including," "containing," or "characterized by" is inclusive or open-ended and does not exclude additional, unrecited elements or method steps. "Comprising" is a term of art used in claim language which means that the named elements are essential, but other elements can be added and still form a construct within the scope of the claim.

As used herein, the phrase "consisting of" excludes any element, step, or ingredient not specified in the claim. When the phrase "consists of" appears in a clause of the body of a claim, rather than immediately following the preamble, it limits only the element set forth in that clause; other elements are not excluded from the claim as a whole.

As used herein, the phrase "consisting essentially of" limits the scope of a claim to the specified materials or steps, plus those that do not materially affect the basic and novel characteristic(s) of the claimed subject matter.

With respect to the terms "comprising", "consisting of", and "consisting essentially of", where one of these three terms is used herein, the presently disclosed and claimed subject matter can include the use of either of the other two terms.

It will be understood that various details of the presently disclosed subject matter may be changed without departing from the scope of the presently disclosed subject matter. Furthermore, the foregoing description is for the purpose of illustration only, and not for the purpose of limitation.

What is claimed is:

1. A drying device comprising:

(a) two or more fabric panels of sufficient dimension to be dragged across a surface to be dried;

(b) a handle attached to the two or more fabric panels; and (c) a scraper attached to the handle, wherein the scraper is adapted to engage said surface when the drying device is in use, wherein the weight of the two or more panels and/or resistance of the two or more panels as they are dragged across said surface act as a counterbalance to drive the scraper to engage said surface.

2. The drying device of claim 1, wherein the two or more fabric panels comprise a microfiber fabric.

3. The drying device of claim 2, wherein the microfiber fabric comprises a pulverized plastic.

4. The drying device of claim 1, wherein the two or more fabric panels comprise a sleeve defined by the two or more panels and the handle contacts the sleeve.

5. The drying device of claim 1, wherein the handle comprises a pipe and a rope.

6. The drying device of claim 1, wherein the handle comprises a first pipe and a second pipe, oriented such that the two or more fabric panels are encased between the first and second pipes.

7. The drying device of claim 1, comprising an end cap placed on each end of the handle.

8. The drying device of claim 5, comprising a hook at each end of the handle or one or more hooks at one or more positions along the rope.

9. The drying device of claim 1, comprising a logo on at least one side.

10. The drying device of claim 1, further comprising:

a bag for carrying the drying device.

11. The drying device of claim 10, wherein the bag comprises a logo on at least one side.

12. The drying device of claim 1, wherein said surface to be dried is an outdoor hard court.

13. The drying device of claim 12, wherein the outdoor hard court is a tennis court.

14. The drying device of claim 5, wherein the rope is threaded through the pipe and/or attached at each end of the pipe.

15. The drying device of claim 4, wherein the handle comprises a first pipe and a second pipe, oriented such that the sleeve is encased between the first and second pipes.

* * * * *